US005121782A

United States Patent [19]

Renkhoff et al.

[11] Patent Number: 5,121,782

[45] Date of Patent: Jun. 16, 1992

[54] PROTECTIVE COVERING FOR A MARQUEE ON AN ARTICULATED ARM

[75] Inventors: Hans W. Renkhoff; Wolfgang Mittmann, both of Marktheidenfeld; Gunter Ruckstetter, Rothenfels; Claus Moser, Erlenbach, all of Fed. Rep. of Germany

[73] Assignee: Warema Renkhoff GmbH & Co. KG, Marktheidenfeld, Fed. Rep. of Germany

[21] Appl. No.: 645,488

[22] Filed: Jan. 24, 1991

[30] Foreign Application Priority Data

Jan. 29, 1990 [DE] Fed. Rep. of Germany ... 9000939[U]

[51] Int. Cl.[5] ..... E04F 10/00

[52] U.S. Cl. ..... 160/22; 160/26; 160/29

[58] Field of Search ..... 160/22, 23.1, 26, 29, 160/66, 70, 79; 135/89

[56] References Cited

U.S. PATENT DOCUMENTS

| | | | |
|---|---|---|---|
| 1,033,198 | 7/1912 | Saunders | 160/22 |
| 3,292,685 | 12/1966 | Clark | 160/26 |
| 3,337,926 | 8/1967 | Daugherty | 248/214 X |
| 3,364,973 | 1/1968 | Railson | 160/22 |
| 3,575,371 | 4/1971 | Carlstedt | 248/215 |
| 3,653,624 | 4/1972 | Abel | 248/215 X |
| 3,827,677 | 8/1974 | Meyerhoefer et al. | 248/692 X |
| 3,923,074 | 12/1975 | McKee | 160/22 X |
| 4,101,108 | 7/1978 | Klein | 248/301 X |
| 4,405,052 | 9/1983 | Spiros | 248/243 X |

FOREIGN PATENT DOCUMENTS

| | | | |
|---|---|---|---|
| 3015990 | 11/1981 | Fed. Rep. of Germany | 160/22 |
| 8234113.3 | 5/1983 | Fed. Rep. of Germany . | |
| 8811102.4 | 12/1988 | Fed. Rep. of Germany . | |
| 811.904 | 4/1937 | France . | |
| 1352955 | 1/1964 | France | 248/214 |
| 2022184 | 12/1979 | United Kingdom | 160/26 |

*Primary Examiner*—Carl D. Friedman
*Assistant Examiner*—Korie H. Chan
*Attorney, Agent, or Firm*—Larson and Taylor

[57] ABSTRACT

The protective covering for a marquee consists of a casing (22) carrying a winding shaft and having a discharge opening extending along the entire length of the casing, which can be closed tightly by a top flap (42) and a bottom flap (46). Top flap (42) is pivoted upward during the discharge of the marquee by its outer tube (14) counter to the force of gravity and following the re-entry of the marquee drops back into its closed position. Bottom flap (46) drops during the discharge of the marquee by its own specific gravity into open position and is drawn back into closed position at the end of the re-entry movement by means of closing levers (76) remaining in the movement path of the outer tube. The quite small top flap (42) cleans off the marquee, but loads it with only a slight weight. The pressure of the outer tube (14) against the closing levers (76) holds flaps (42, 46) dependably closed tightly in the re-entry position/closed position.

12 Claims, 3 Drawing Sheets

PROTECTIVE COVERING FOR A MARQUEE ON AN ARTICULATED ARM

FIELD OF THE INVENTION

The invention relates to a protective covering for a marquee, especially a marquee suspended on articulated arms. It consists of a casing closing on the side, carrying a winding shaft, with a thrust and retractable discharge opening extending along the entire length of the casing. When the marquee has re-entered therein the casing can be closed tightly by a cover device which can pivot around the casing, which cover device can be operated in the direction of opening during the retractable discharge of the marquee from its outer . tube normally called a "drop tube".

BACKGROUND OF THE INVENTION

Marquees with a protective covering are indicated in general terms as "cassette marquees." In the case of earlier embodiments of such marquees when the marquee is in the re-entry or concealed state, the casing is closed tightly by the drop tube which is configured like a covering. However sealing problems then arise, and a relatively wide clearance remains between the marquee fabric or material and the top opening edge of the casing. When the marquee is in the retractably discharged state. dirt or pollutants may penetrate into the casing through said clearance and therein may be deposited on the winding shaft and on the articulated arm suspension.

It has already been suggested in German Utility Patent 88 11 102 that when the marquee has re-entered and is covered by an articulated flap cover suspended by articulation at the top edge of the opening, that the discharge opening be sealed shut with a curved or bent profile member. The profile member is swivelled by spring bias against the other opening edge. and when the marquee is rectractably discharged it is raised by the gravity drop tube member counter to the spring bias. Since the opening to be closed by the hinged cover requires a considerable height range in order to be adjusted to different marquee inclinations, the flap cover extending in the closed state to beneath the winding shaft and the articulation arm suspension, whatsoever material it consists of, incorporates a considerable mass. Consequently the closing springs must also be considered to be part of the dimensions of the arrangement, which leads to a great friction of the opened cover upon the marquee material. Also, if there is any metal fatigue or even a break of the closing springs, the problem-free tight closing of the casing cannot be guaranteed.

SUMMARY OF THE INVENTION

The object of the invention is thus to further develop a protective covering of the aforementioned type, that can be constructed so that on the one hand the covering device is lighter and less voluminous and so that on the other hand even following long use a tight closing of the casing when the marquee is re-entered and concealed is guaranteed.

According to the invention this object is attained in that the cover device consists of a top flap and a bottom flap which is attached to the top flap when in closed position. Both flaps are mounted so that they can each pivot on the casing, and during the retractable thrust discharge the drop tube thrusts the top flap in opening direction, in opposition to a closing force. At the end of the re-entry and concealing movement the cover device draws up the bottom flap into the closed position by means of closing levers which are connected with it, said closing levers remaining in the path of movement of the drop tube. in opposition to a force working in the opening direction.

Some advantageous configurations of the invention are disclosed hereinafter.

One preferred exemplary embodiment of the invention is shown in greater detail hereinafter in the drawing.

DETAILED DESCRIPTION OF THE PREFERRED EMBODIMENTS

Figure 1:
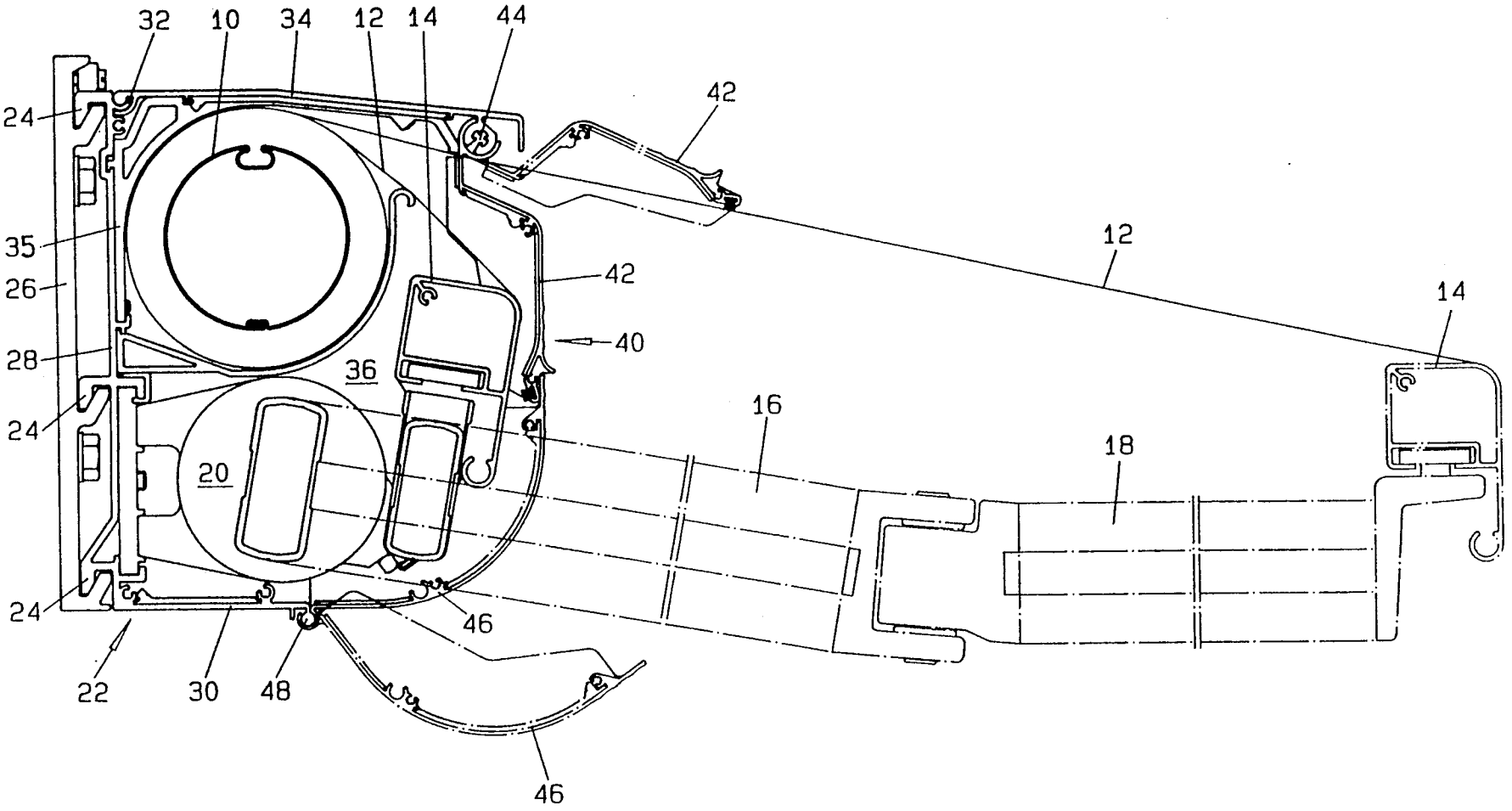
FIG. 1 is a transverse section through a marquee with articulated arms with the protective covering according to the invention in the area of the articulated arms, in which marquee and protective covering are represented in re-entered and concealed state in full lines and in retractably discharged state in dot-dash lines, FIG. 2 in somewhat larger scale shows a transverse section through the marquee and the protective covering at a different point outside the area of movement of the articulated arms with the operational device actuating the protective covering, in which again the marquee and the protective covering are shown in re-entered and concealed state in full lines and in retractably discharged state in dot-dash lines.

In the drawings the winding shaft 10 is part of a marquee with articulated arms, from which a marquee fabric or material 12 can be drawn obliquely to the right and downward by means of a drop tube 14 configured as a segment of an extruded profile. The position of drop tube 14 is controlled in a known manner by its mounting on the two articulation arms of the marquee consisting of the two arms 16, 18, which are articulated below winding shaft 10 on an articulation arm support 20.

The aforementioned parts of the marquee are mounted in a casing 22 when in a re-entered and concealed state. The marquee is suspended at the rear with hooks 24 fitting in the supports 26 tight on the wall where it is secured in a suitable manner. A relatively short bottom wall 30 is tip-stretched for attachment to the bottom of the closed rear wall 28 of the casing. The top end of rear wall 28 incorporates a recess 32 for the pivoting in of a top wall 34, which first extends parallel to bottom wall 30 and then is angled slightly downward over the winding shaft. Stop blocks 35 are distributed along the entire length of the casing, where they are inserted in guides on the inside of rear wall 28 and on top wall 34. Stop blocks 35 hold top wall 34 in position relative to rear wall 28 and at the same time work as stiffeners. The outside ends of casing 22 are closed by end walls 36 being screwed thereon.

Between bottom wall 30 and top wall 34 is formed an opening 40 for retractable discharge of the marquee. Opening 40 is limited by end walls 36, and can be closed tightly by a cover device. The cover device in turn consists of a top flap 42, which at pivot 44 is articulated to the open longitudinal edge of top wall 34, and a bottom flap 46, which is articulated at pivot 48 to the open longitudinal edge of bottom wall 30. In closed state the contour of the cover device first runs obliquely forward from top wall 34 and then runs perpendicularly downward and then in the curved area is attached to bottom wall 30.

All three longitudinal walls 28, 30, 34 of casing 22 as well as the two flaps 42, 46 are constructed preferably of extruded profile elements which are cut to length and are of aluminum the same as end walls 36. On the one hand this material guarantees the required stiffness of these members even when the casing is very long, and on the other hand this material is simple to cover with varnish or lacquer.

Figure 3:
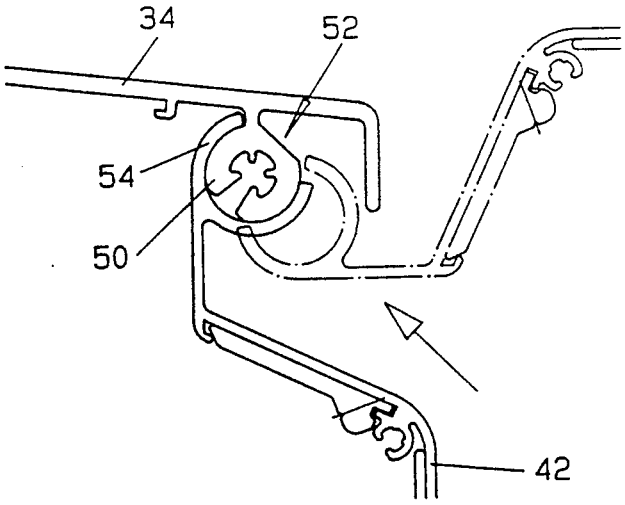
FIG. 3 is a detail of FIG. 2 showing the articulation of the top flap in still larger scale.

The catch-attachments of flaps 42, 46 on top wall 34 or respectively on bottom wall 30, as is shown in the example of FIG. 3 showing the top attachment, are undertaken with the aid of a bead or bulb reinforcement 50 of circular profile which is flattened out at opposing portions. Around the one flattened portion away from the top wall 34, the catch-attachment and hence top flap 42 can be pivoted in a circular annular profile 54. Then, together with the other flattened portion there is provided an introduction clearance 52 to mount profile 54. The positioning of the flattened out portions on profile bead or bulb 50 is selected so that this catch-attachment can be introduced at clearance 52 only in the end pivot position of flap 42 indicated with dot-dash line and along the direction indicated by the arrow, which position is not reached/attained in normal operation.

Figure 2:
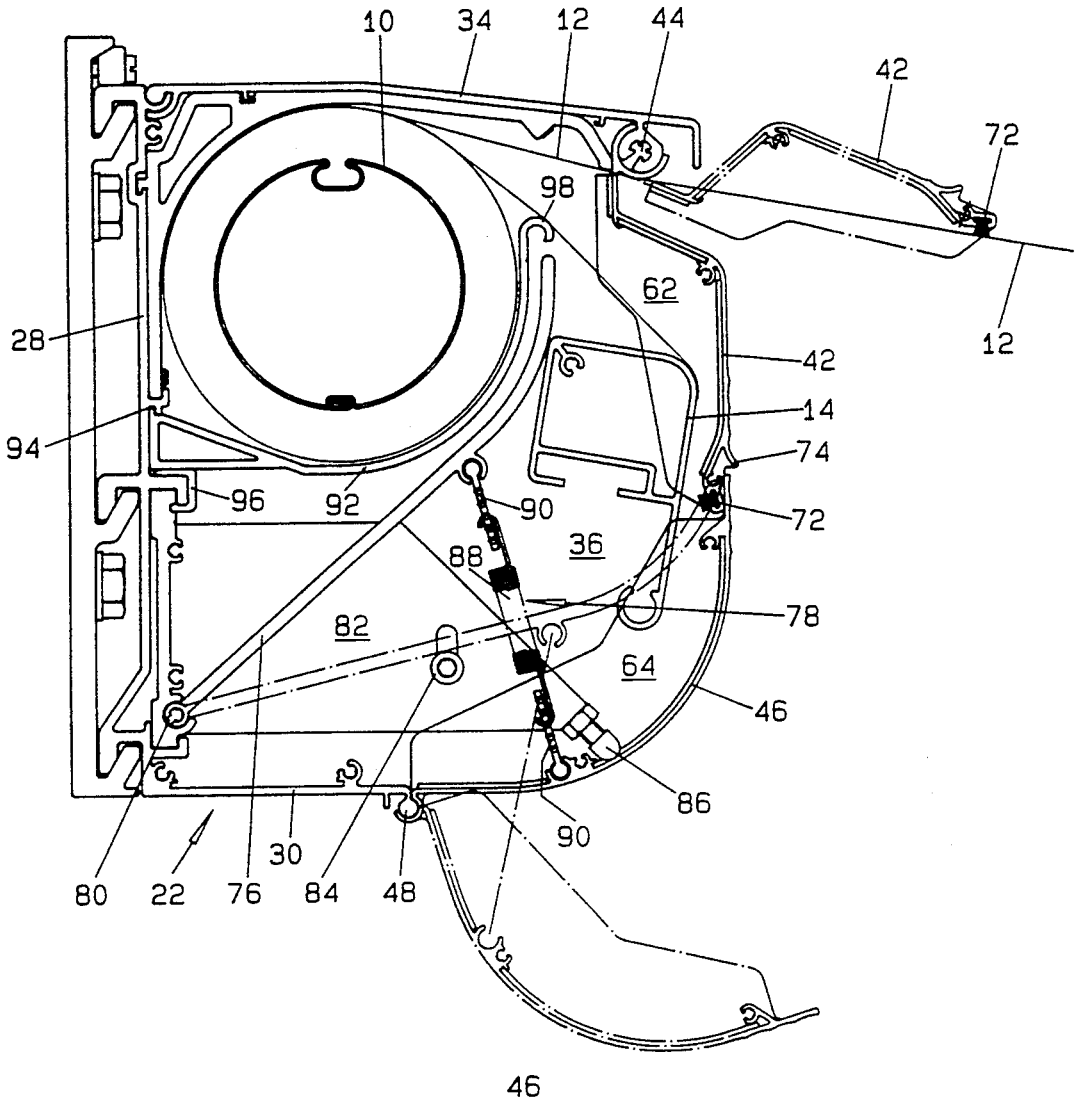
Figure 4:
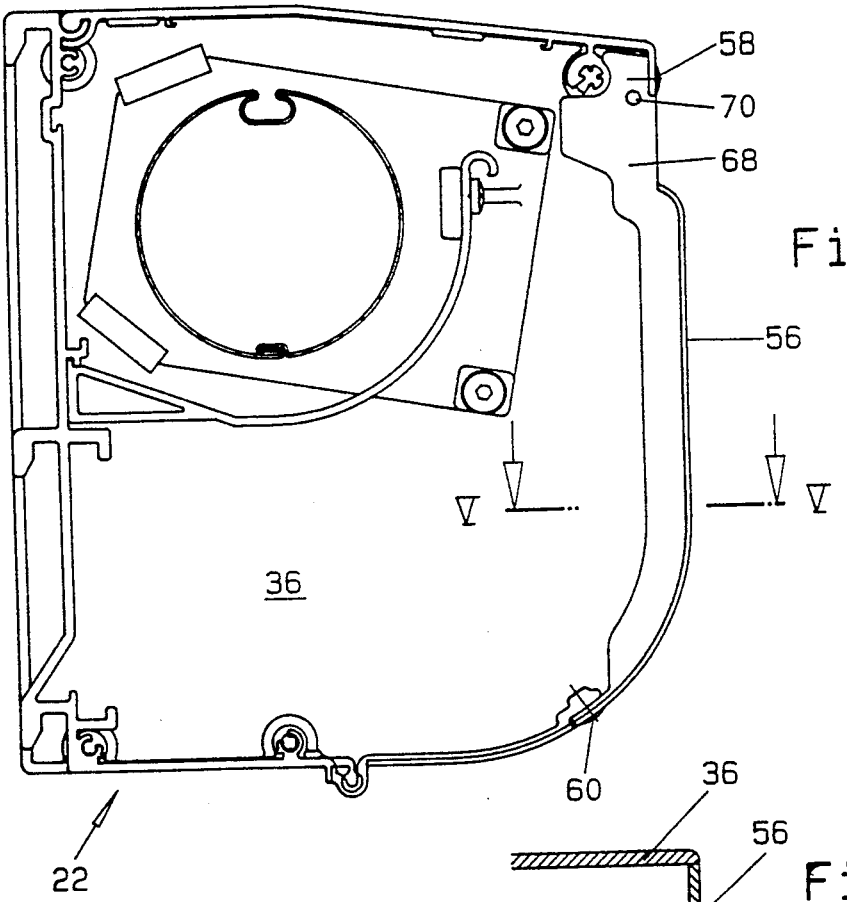
FIG. 4 is another transverse section through the marquee and the protective covering along line IV—IV of FIG. 5 directly in front of the one end wall.
Figure 5:
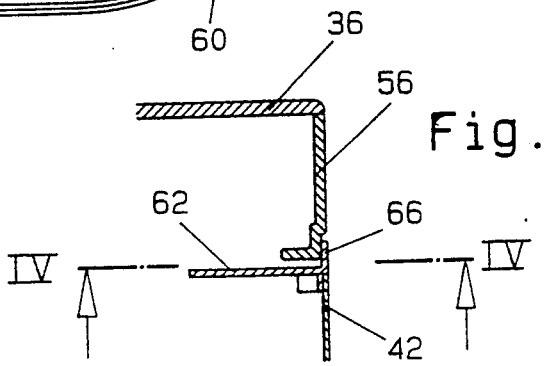
FIG. 5 is a horizontal section along line V—V of FIG. 4.

Each end wall 36, as is particularly apparent in FIG. 4, is configured essentially to the contour of the cover device and is dish-shaped. In one portion of retractable thrust discharge opening 40 the border of the dish is replaced by a removable inspection cover 56, which can be screwed tightly onto the border of the dish with screws 58 and 60. At the ends of flaps 42, 46 plastic shields 62 and 64 are mounted on the inside (FIG. 2), where they also stiffen the flaps. Shields 62 and 64 are provided with packing washers 66 (FIG. 5), which when the flaps are closed overlap the inspection cover 56 and the part of the dish wall in the countersunk border areas attaching at the bottom end of cover 56, and thus seal flaps 42, 46 to end walls 36. Inspection cover 56 is beveled inward at portion 68 and at its top end supports a trip pin or positioning pin 70 in the pivot area of top flap 42, which pin prevents any pivoting or rolling of the top flap into the top aforementioned end position without prior release of inspection cover 56.

When the flaps are closed, bottom flap 46 with its free longitudinal edge overlaps top flap 42. The profile of the outside edge of top flap 42, bent slightly inward and then again outward, incorporates a groove which is open at the top into the inside of the casing and a brush strip 72 is carried therein. A drip strip 74, projecting over bottom flap 46, is also tip-stretched onto the outside of top flap 42.

Top flap 42 assumes its closed setting shown in the example solely under the effect of the force of gravity and is incorporated into the outward rectractable thrust of the marquee first of all by the drop tube 14 and then is raised and then held up by the marquee material 12 against the effect of the force of gravity. Thus top flap 42 with brush strip 72 is supported against the top of the marquee fabric or material 12 and upon re-entry of the marquee provides cleaning of the marquee fabric or material by scraping off dust and deposited residues along with leaves and other sediments.

On the other hand for bottom flap 46, on which the force of gravity works in the direction of opening of the flap, a special closing mechanism is provided. The closing mechanism consists of at least two closing levers 76 arranged outside the possible range of movement of articulation arms 16, 18 and having associated couples 78, which connect closing levers 76 with bottom flap 46 by articulation. Closing levers 76 are mounted at the bottom end of casing rear wall 28 at point 80 and are bent outward at their ends. With each closing lever 76 is also associated a cheek 82 fastened to the casing rear wall and extending directly adjacent to closing lever 76 toward bottom flap 46. Cheek 82 supports on the one hand an adjustable detent 84 to limit the opening movement of closing lever 76 and on the other hand another adjustable detent 86 effecting bottom flap 46. Instead of the above, only one single adjustable detent could be provided for top flap 42, and in that case this detent then serves in the closed setting as a detent for bottom flap 46.

Couples 78 are configured to be elastically biased and consist each in turn of one traction or tension spring 88. The hook-shaped ends of spring 88 are suspended in perforated belts 90, which are mounted articulately on closing levers 76 and bottom flap 46.

With the re-entry of the marquee, the closing levers 76 pulled away from detents 84 are picked up on the bent outside ends of drop tube 14 and pivoted upward. Closing levers 76 carry along bottom flap 46 by means of couples 78, until said flap is captured by detents 86. Before this, top flap 42 has already attained its closed position shown with the full lines in FIG. 2, so that when bottom flap 46 is closed it may overlap top flap 42. With further introduction of the re-entry of the marquee, closing levers 76 are pivoted further upward and thus stretch out the spring-biased couples 78, so that bottom flap 46 is held with bias against detents 86. Thus with accurate setting of detents 86, an effective seal occurs simultaneously both on the facing overlapping longitudinal edges of flaps 42 and 46 and also on the packing washers of shields 62, 64, sealing them to end walls 36 or respectively to inspection covers 56. The pressure force being applied can be varied by taking up the slack of the ends of the tension springs 88 in the perforated strips 90.

Upon termination of the upward pivoting of closing levers 76, said levers are caught on a troughlike partition 92 extending along the entire length of casing 22. Partition 92 is suspended with a hooked profile 94 in a groove on the casing rear wall 28 and is held securely therein by clip-catching U-shaped interlocking locking elements 96. Partition 92 extends below winding shaft 10 with the marquee material 12 wound thereon and thus separates the winding space from the bottom part of casing 22, whereupon the marquee material is protected from damage and pollution. The free longitudinal edge 98 of the partition is curved outward and forms a rounded runoff edge for the marquee material 12.

As a result of the adjustability of detents 84 affecting closing levers 76, the opening angle of bottom flap 46 can be adapted to the retractable thrust discharge opening 40 for different inclinations of the marquee.

In one modification of the exemplary embodiment which is shown, an additional return spring can load top flap 42 in the closing direction. Alternatively also, a spring could load bottom flap 46 in the opening direction and this could be coupled for instance through a chain or belt drive or a lever drive in such a manner with top flap 42 that during the opening of bottom flap 46 said top flap is likewise opened. In this case then top flap 42 is controlled only indirectly by drop tube 14. Finally then at least the closing levers could pivot bottom flap 46 not directly by means of drop tube 14 but rather by means of a part moved simultaneously in the beginning phase of the retractable thrust discharge and the final phase of the re-entry, which for instance is brought by the drop tube into coupling/clutch engagement with the winding shaft, and therefore are also operated only indirectly by the drop tube.

Irrespective of narrow slots in end walls 36 the protective covering functions in the same manner when the drop tube is not guided by articulation arms but rather is guided in two guide rails arranged at the sides with pulling members mounted therein.

We claim:

1. A protective covering for a marquee wound on a winding shaft and an outer tube mounted on articulated arms for extending and retracting the marquee comprising:

an elongate casing including closed lateral sides, said casing enclosing the winding shaft for the marquee as well as the outer tube and further including a discharge opening along a length thereof through which the arms are articulated to extend and retract the outer tube and hence to extend and retract the marquee;

a cover device which tightly covers said discharge opening in a closed position when the marquee is in a retracted position in said casing and which is opened by movement of the outer tube as the marquee is extended, said cover device including a top flap and a bottom flap;

a top mounting means for mounting said top flap for pivoting movement to said casing between a closed position toward which said top flap is biased and an open position to which said top flap is moved by engagement with the outer tube and marquee when the outer tube is extended;

a bottom mounting means for mounting said bottom flap for pivoting movement to said casing between an open position toward which said bottom flap is biased and a closed position; and a bottom closing lever means for moving said bottom flap to the closed position against the bias to the open position by engagement with the outer tube at an end of the retracting of the outer tube into said casing, said bottom closing lever means being connected to said bottom flap for movement therewith and wherein when said bottom flap is in the open position said bottom closing lever means remains positioned to be engaged by the outer tube at the end of the retracting of the outer tube into said casing.

2. A protective covering for a marquee as claimed in claim 1 wherein said top flap has a free longitudinal lower edge and said bottom flap has a free longitudinal upper edge, and wherein in the closed positions of said flaps said upper edge of said bottom flap overlaps and is outside of said lower edge of said top flap.

3. A protective covering for a marquee as claimed in claim 1 wherein said bottom closing lever means includes at least two closing levers, a respective lever mounting means for pivotally mounting each said closing lever to said casing, and a respective spring biased couple means for coupling each said closing lever to said bottom flap.

4. A protective covering for a marquee as claimed in claim 3 wherein each said couple means includes a tension spring having hooked ends, a first perforated strip which is pivotally attached to an associated said closing lever and in which one of said hooked ends of said spring is received, and a second perforated strip which is pivotally attached to said bottom flap and in which the other one of said hooked ends of said spring is received.

5. A protective covering for a marquee as claimed in claim 3 wherein said bottom closing lever means further includes for each said closing lever an adjustable detent to limit the pivoting movement of the associated said closing lever as bottom flap is moved to the open position.

6. A protective covering for a marquee as claimed in claim 2 wherein said bottom closing means includes adjustable detents for limiting movement of said bottom flap to the closed position.

7. A protective covering for a marquee as claimed in claim 1 wherein said lateral sides are dish shaped end walls having a dish border, and wherein said top flap and said bottom flap include front ends and packing washers at said front ends which engage associated said dish borders when said flaps are in the closed positions.

8. A protective covering for a marquee as claimed in claim 7 and further including a detachable inspection cover provided as part of said dish border of one of said end walls and adjacent said discharge opening.

9. A protective covering for a marquee as claimed in claim 1 wherein said top flap includes a lower longitudinal edge having a groove provided therealong and a brush strip which is located in said groove such that said brush strip slidingly engages the marquee as said top flap is in the open position and the marquee is extended and retracted.

10. A protective covering for a marquee as claimed in claim 2 wherein said top flap further includes a drip strip above said free longitudinal top edge, said drip strip projecting outwardly from said top flap and over said free longitudinal bottom edge in the closed position of said flaps.

11. A protective covering for a marquee as claimed in claim 1 wherein said top mounting means and said bottom mounting means each include a hinge-like bearing for mounting an associated said flap to said casing, each said bearing including a circular profile reinforcement which is flattened on opposite radial sides and a circular annular profile which rotatably encloses said circular profile reinforcement and which is opened at a periphery thereof such that a radial assembly of said profile to said reinforcement is possible at a position other than that normally attained by the associated said flap in movement between the open and closed positions; and further including a detachable inspection cover provided as part of one of said lateral sides and adjacent said discharge opening, said inspection cover including a projection projecting into a pivot area of said top flap to prevent said top flap from reaching the radial assembly position when said inspection cover is in place.

12. A protective covering for a marquee as claimed in claim 1 and further including a bearing dish extending along the length of said casing in which the winding shaft for the marquee is received, and a mounting means for detachably mounting said bearing dish to a rear wall of said casing such that the winding shaft is located in an upper portion of said casing above the articulated arms and said bottom closing lever means.

* * * * *